US011476602B2

(12) United States Patent
Guo et al.

(10) Patent No.: US 11,476,602 B2
(45) Date of Patent: Oct. 18, 2022

(54) EYE-OF-NEEDLE TERMINAL

(71) Applicant: SUZHOU PIN SHINE TECHNOLOGY CO., LTD., Jiangsu (CN)

(72) Inventors: Xiaokang Guo, Jiangsu (CN); Mengcheng Zhang, Jiangsu (CN)

(73) Assignee: SUZHOU PIN SHINE TECHNOLOGY CO., LTD., Jiangsu (CN)

( * ) Notice: Subject to any disclaimer, the term of this patent is extended or adjusted under 35 U.S.C. 154(b) by 6 days.

(21) Appl. No.: 17/262,650

(22) PCT Filed: Mar. 12, 2019

(86) PCT No.: PCT/CN2019/077752
§ 371 (c)(1),
(2) Date: Jan. 22, 2021

(87) PCT Pub. No.: WO2020/019726
PCT Pub. Date: Jan. 30, 2020

(65) Prior Publication Data

US 2021/0305729 A1 Sep. 30, 2021

(30) Foreign Application Priority Data

Jul. 25, 2018 (CN) ..... 201821181212.4

(51) Int. Cl.
*H01R 13/42* (2006.01)
*H01R 12/58* (2011.01)
(Continued)

(52) U.S. Cl.
CPC ..... *H01R 12/585* (2013.01); *H01R 12/716* (2013.01); *H01R 12/722* (2013.01)

(58) Field of Classification Search
CPC .... H01R 12/585; H01R 12/716; H01R 12/58; H01R 12/724; H01R 12/79; H01R 12/714; H01R 13/6658; H01R 12/7064
See application file for complete search history.

(56) References Cited

U.S. PATENT DOCUMENTS 4,655,537 A * 4/1987 Andrews, Jr. ..... H01R 12/585 439/82
4,897,053 A * 1/1990 Verhoeven ..... H01R 12/585 439/82

(Continued)

FOREIGN PATENT DOCUMENTS

CN 203747071 U 7/2014
CN 203983559 U 12/2014

(Continued)

OTHER PUBLICATIONS

International Search Report for International Patent Application No. PCT/CN2019/077752, dated Jun. 17, 2019 in 4 pages.

(Continued)

*Primary Examiner* — Truc T Nguyen
(74) *Attorney, Agent, or Firm* — Knobbe, Martens, Olson & Bear, LLP

(57) ABSTRACT

An eye-of-needle terminal, comprising a base portion (1), a pin portion (3), and an elastic portion (2) disposed between the base portion and the pin portion. The elastic portion is provided with an eye-of-needle hole (4), and the extension direction of the eye-of-needle hole is the same as that of the elastic portion. The eye-of-needle hole comprises flared holes (42) located at both ends and a connecting hole (41) located between the two flared holes. The width of the end of each flared hole facing the connecting hole is greater than the width of the end distant from the connecting hole. Thereby not only ensuring that the eye-of-needle terminal is very easy to insert, but also ensuring that the eye-of-needle (Continued)

terminal forms a good connection with a conductive through hole after being inserted and does not easily come out of the conductive through hole.

12 Claims, 6 Drawing Sheets

(51) Int. Cl.
*H01R 12/71* (2011.01)
*H01R 12/72* (2011.01)

(56) References Cited

U.S. PATENT DOCUMENTS

| | | | | |
|---|---|---|---|---|
| 7,780,483 | B1 * | 8/2010 | Ravlich | H01R 12/585 439/82 |
| 8,313,344 | B2 * | 11/2012 | Johnescu | H01R 12/585 439/571 |
| 8,727,814 | B2 * | 5/2014 | Redder | H01R 12/585 439/751 |
| 8,992,235 | B2 * | 3/2015 | Kataoka | H01R 13/05 439/82 |
| 10,096,917 | B1 * | 10/2018 | Myer | H01R 12/585 |
| 10,547,128 | B1 * | 1/2020 | Lin | H01R 12/585 |
| 10,630,007 | B2 * | 4/2020 | Kishibata | H01R 12/585 |
| 10,680,360 | B2 * | 6/2020 | Yagyu | H05K 3/308 |

FOREIGN PATENT DOCUMENTS

| | | | |
|---|---|---|---|
| CN | 205985434 | U | 2/2017 |
| CN | 208444977 | U | 1/2019 |
| JP | 2016-225173 | A | 12/2016 |

OTHER PUBLICATIONS

Written Opinion for International Patent Application No. PCT/CN2019/077752, dated Jun. 17, 2019 in 4 pages.

* cited by examiner

EYE-OF-NEEDLE TERMINAL

CROSS-REFERENCE TO RELATED APPLICATIONS

This application is the U.S. National Phase under 35. U.S.C. § 371 of International Application PCT/CN2019/077752, filed Mar. 12, 2019, which claims priority to Chinese Patent Application No. 201821181212.4, filed Jul. 25, 2018. The disclosures of the above-described applications are hereby incorporated by reference in their entirety.

TECHNICAL FIELD OF THE INVENTION

The present disclosure relates to the field of connector technology, in particular, to an eye-of-needle terminal.

BACKGROUND OF THE INVENTION

Generally, there are multiple connection methods between a communication connector or an electric connector and a circuit board, and one method is to use an insert compliant terminal. The eye-of-needle terminal is the most wildly used insert compliant terminal to transmit electrical signals, which has advantages of easy assembly, tightly connecting the connector and PCB without using soldering to transmit electrical signals. In addition, the connector can be replaced, and if the device is damaged, it can be directly removed from the PCB and replaced with a new device. It has the characteristics of stability, simplicity, speed, and can match the smaller conductive through holes on the circuit board. When inserting, two elastic portions of the eye-of-needle terminal are squeezed to generate elastic contraction, so that the eye-of-needle terminal is successfully inserted into the conductive through hole of the circuit board, thereby achieving the connection between the eye-of-needle terminal and the circuit board without soldering, and being convenient to replace. The eye-of-needle terminal is inserted into the conductive through hole of the PCB through the contraction of the two elastic portions to export signals.

The structure of the existing eye-of-needle terminal successively comprises a base portion, two elastic portions connected with the base portion, and a pin portion connected with the two elastic portions; the elastic portions is arc-shaped, the two elastic portions are opposite provided, and between the two elastic portions is formed an eye-of-needle hole; the cross section of the elastic portions is equal everywhere from one end near the base portion to the other end. The problems of the eye-of-needle terminal of such design are: if the cross section of the elastic portions is small, the elastic portions are easy to elastically contract when being squeezed, with good contraction performance, and such eye-of-needle terminal is easy to insert, while the eye-of-needle terminal is easy to escape from the conductive through hole after inserting, and once the eye-of-needle terminal exits from the conductive through hole, an open circuit occurs, which has a unreliable electric connection, and is easy to failure and cause unstable signals or missing; if the contact surface between the eye-of-needle terminal and the conductive through hole, and the diameter of the elastic portions are increased, in this way, the cross section of the elastic portions is large, the elastic portions are not easy to elastically contract when being squeezed, while the eye-of-needle terminal is not easy to escape from the conductive through hole after inserting, thus ensuring a reliable electric connection with the circuit board, while inserting the terminal will be laborious, and metal powder may be generated at the contact surface when the terminal is separated from the circuit board, the contraction performance of the eye-of-needle terminal generated by combining the two circular arcs together is poor, such elastic principle is not enough to meet the requirements of performance.

SUMMARY OF THE INVENTION

On this account, to over come the defects of the current technology, the purpose of the present disclosure is to provide an eye-of-needle terminal with reasonable structure, more uniform stress, and more convenient insertion and removal.

To achieve the above purpose, the present disclosure employs the following technical solution:

An eye-of-needle terminal, comprises a base portion, a pin portion, and an elastic portion disposed between the base portion and the pin portion, the elastic portion is provided with an eye-of-needle hole, the extension direction of the eye-of-needle hole is the same as that of the elastic portion, the eye-of-needle hole comprises flared holes located at both ends and a connecting hole located between the two flared holes, and the width of the end of each flared hole facing the connecting hole is greater than the width of the end distant from the connecting hole. The eye-of-needle terminal is flat, and four sides thereof are respectively two oppositely arranged platform surfaces and two oppositely arranged arc side surfaces. By combining this buffer with the eye-of-needle terminal to insert or remove, when being inserted into a conductive through hole of a PCB, the elastic portions are contracted with respect to each other and inserted into the conductive through hole, after the eye-of-needle terminal is inserted in place, the elastic portions are slowly released to generate an elastic force, and the eye-of-needle terminal is fixed to the conductive through hole by the elastic force, forming a connector for transmitting electric signals. The four corner angles of the arc side surfaces are arced, and is rounded to achieve a smooth surface, protecting the contact surface. The front ⅓ of the eye-of-needle terminal is the insertion guide portion, and the middle ⅓ of the eye-of-needle terminal is the portion that elastically contacts the conductive through hole of the PCB.

Preferably, a width of the connecting hole is greater than a width of the flared hole. That is, the eye-of-needle terminal is wide at the middle and narrow at both ends, it can not only increase the contractive elasticity of the eye-of-needle terminal, but also make different positions of the two opposite elastic portions have different contraction performance, which is convenient to use, on one hand, it can ensure that the eye-of-needle terminal is very easy to insert, and on the other hand it can ensure that the eye-of-needle terminal forms a good connection with the conductive through hole after being inserted and does not easily come out of the conductive through hole, so that the eye-of-needle terminal can be more securely fitted and connected to the conductive through hole of the PCB, and achieve more reliable signal transmission.

More preferably, the width of the connecting hole is 1.5-2.5 times the width of the flared hole. In some embodiment, the width of the connecting hole is 2 times the width of the flared hole.

Preferably, the two ends of the eye-of-needle hole is arced, and connections between the connecting hole and the flared holes are arced. The arc configuration enables the stress of the eye-of-needle terminal more balanced when inserting into and removing from the conductive through hole, and the arc configuration makes the eye-of-needle terminal more concise and artistic.

Preferably, the elastic portions comprise a first elastic portion and a second elastic portion, and the first elastic portion and the second elastic portion are oppositely arranged to form the eye-of-needle hole. The first elastic portion and the second elastic portion are symmetrically arranged.

Preferably, the edge of the eye-of-needle hole is provided with an inclined chamfer. Preferably, the inclined surface of the inclined chamfer faces the outside, and an angle between the inclined surface and the platform surface of the eye-of-needle terminal is 30-60°, preferably 45°. The advantage of providing the inclined chamfer is that if it needs to be permanently and fixedly tin-containing solder, the melted tin-containing solder can pass through the inclined chamfer as an introduction hole, so that more tin can enter the eye-of-needle hole, and the connection between the eye-of-needle terminal and the conductive through hole is more tight, preventing problems such as poor contact caused by virtual welding.

Preferably, inclined surfaces are provided around the end of the pin portion, and the inclined surfaces enable the end of the eye-of-needle terminal to be inserted into the conductive through hole more conveniently.

More preferable, a bottom edge of each inclined surface comprises a straight edge in the middle and arc edges located at two sides of the straight edge, a horizontal projection of the arc edges of four inclined surfaces may combine into a first circle, and the arc configuration causes the end portion of the eye-of-needle terminal can be more conveniently inserted into the conductive through hole and avoid damage to the conductive through hole by the sharp edges and corners.

Further preferably, one side of the eye-of-needle terminal contacting the conductive through hole are arced, that is, each arc side surface of the elastic portions comprises an arc flat surface in the middle and two circular arc surfaces located at two sides of the arc flat surface. The arc flat surface and the circular arc surfaces cause the eye-of-needle terminal can be more conveniently inserted into the conductive through hole and avoid rigid contact with the conductive through hole, protecting the contact surface.

Still preferably, any four circular arc surfaces at the same position on the two oppositely arranged arc side surface can be combined to form a second circle on the horizontal projection. By means of this configuration, not only causes the eye-of-needle terminal can be more conveniently inserted, will not generate a strong rigid contact with the through hole of the circuit board, ensuring the subsequent electric connection, but also causes elasticity between the first elastic portion and the second elastic portion is moderate, which has a certain resistance to the squeezing of the through hole of the circuit board, so that the eye-of-needle terminal has a longer service life and a reduced damage rate.

Yet preferably, the first circle and the second circle have the same size.

Preferably, a top surface of the end of the pin portion is square. The square configuration causes the end of the eye-of-needle terminal is more uniformly stressed.

Compared with the current technology, the present disclosure has the following beneficial effects: the eye-of-needle terminal of the present disclosure, has a reasonable structure design, by designing the eye-of-needle hole to be wide at the middle and narrow at both ends, so that the cross section of the elastic portions is not equal everywhere, the elastic force between the first elastic portion and the second elastic portion will vary with the stress position and is maintained within the appropriate range, thereby not only ensuring that the eye-of-needle terminal is very easy to insert, but also ensuring that the eye-of-needle terminal forms a good connection with the conductive through hole after being inserted and does not easily come out of the conductive through hole, therefore, the eye-of-needle terminal can be more securely fitted and connected to the conductive through hole of the PCB, achieve more reliable signal transmission, can well solve the problem of poor contact, and can avoid rubbing the conductive through hole of the PCB during insertion and removal, has longer service life; the arc-shaped configurations at multiple positions not only make the eye-of-needle terminal more evenly stressed during insertion and removal, but also make the overall appearance more beautiful and simple.

BRIEF DESCRIPTION OF THE DRAWINGS

For more clearly explaining the technical solutions in the embodiments of the present disclosure, the accompanying drawings used to describe the embodiments are simply introduced in the following. Apparently, the below described drawings merely show a part of the embodiments of the present disclosure, and those skilled in the field can obtain other drawings according to the accompanying drawings without creative work.

wherein, base portion—1, elastic portion—2, first elastic portion—21, second elastic portion—22, pin portion—3, inclined surface—31, eye-of-needle hole—4, connecting hole—41, flared hole—42, are side surface—5, arc flat surface—51, circular arc surface—52, inclined chamfer—6, straight edge—71, arc edge—72, top surface—8, platform surface-13 9.

DETAILED DESCRIPTION OF EXEMPLARY EMBODIMENTS

In order to enable those skilled in the field to better understand the technical solution of the present disclosure, the technical solutions in the embodiments of the present disclosure are explained clearly and fully combining with the accompanying drawings, and apparently, the described embodiments are merely a part of the embodiments of the present disclosure, not all the embodiments. Based on the embodiments of the present disclosure, all other embodiment obtained by one of ordinary skill in the art without creative work should fall within the protective scope of the present disclosure.

It should be noted that terms “first”, “second” and the like in the description, the claims and the accompanying drawings of the present disclosure are used to distinguish similar objects, and do not have to be used to describe a specific order or sequence. It should be understood that the data so used can be interchanged under appropriate circumstances so that the embodiments of the present disclosure described herein can be implemented in an order other than those illustrated or described herein. In addition, the terms "comprise", "comprising", "have", "having" and any variations thereof are intended to cover non-exclusive inclusions, for example, processes, methods, devices, products or equipment that include a series of steps or units are not necessarily limited to those clearly listed steps or units, but may include other steps or units not explicitly listed or inherent to these processes, methods, products or equipment.

Figure 1:
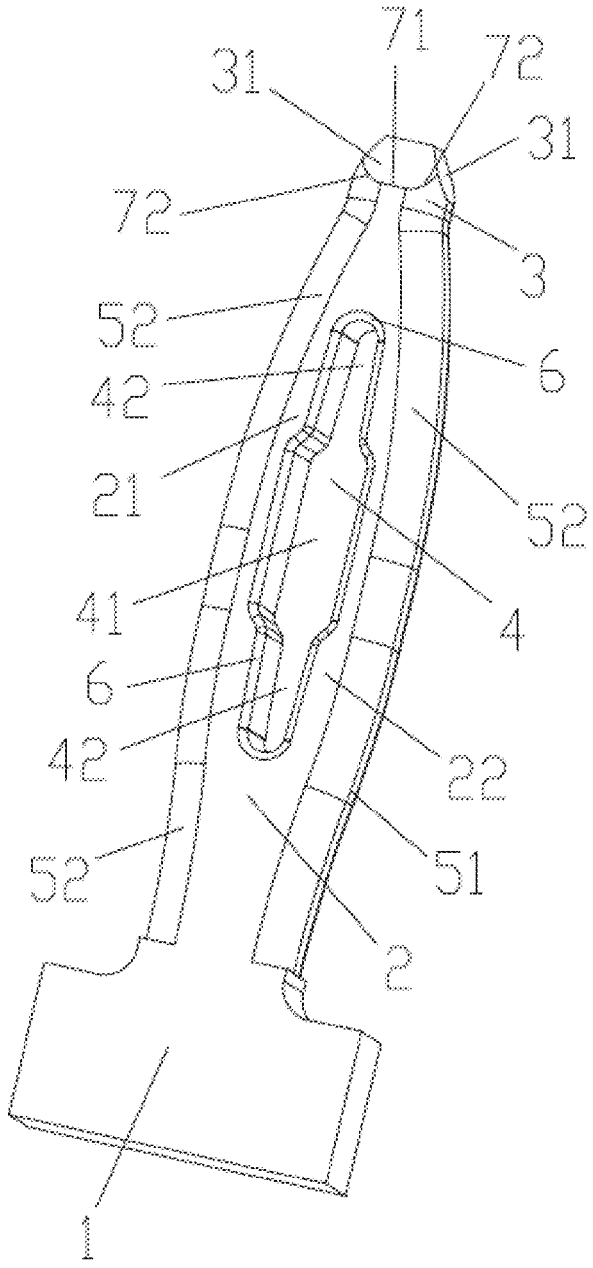
FIG. 1 is a cubic chart of an eye-of-needle terminal in a preferred embodiment of the present disclosure.
Figure 2:
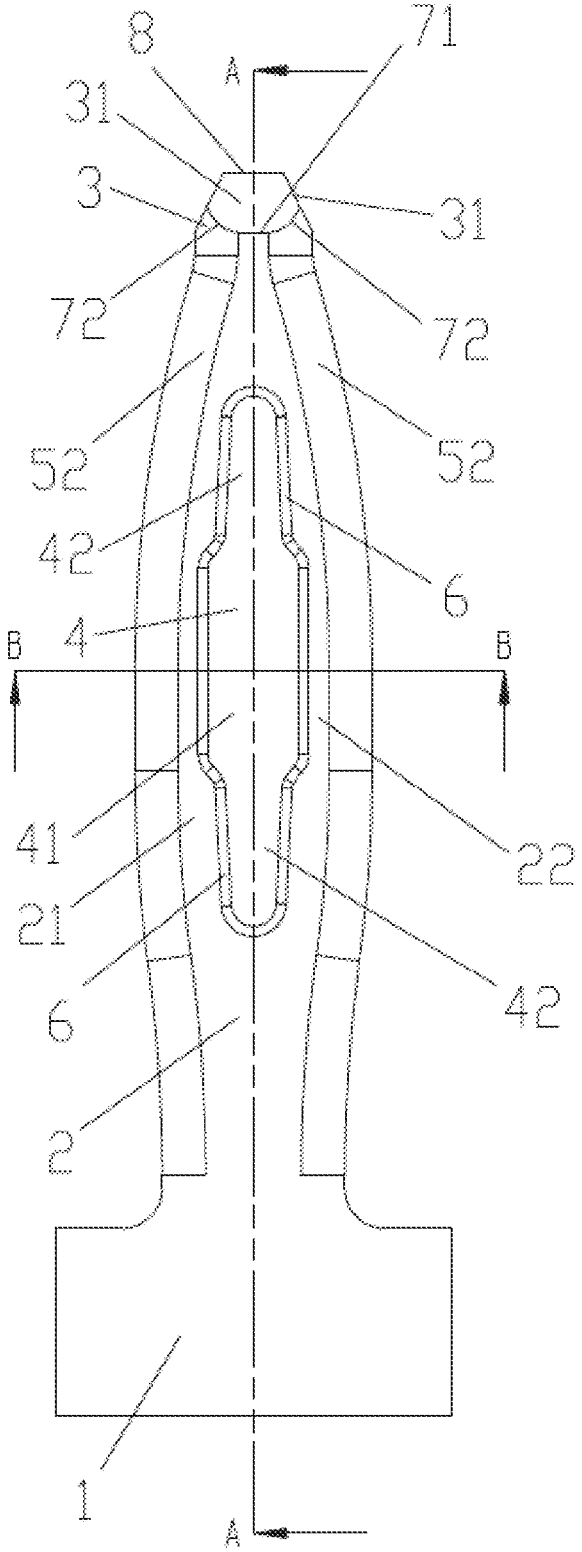
FIG. 2 is a front view of the eye-of-needle terminal in the preferred embodiment of the present disclosure.
Figure 3:
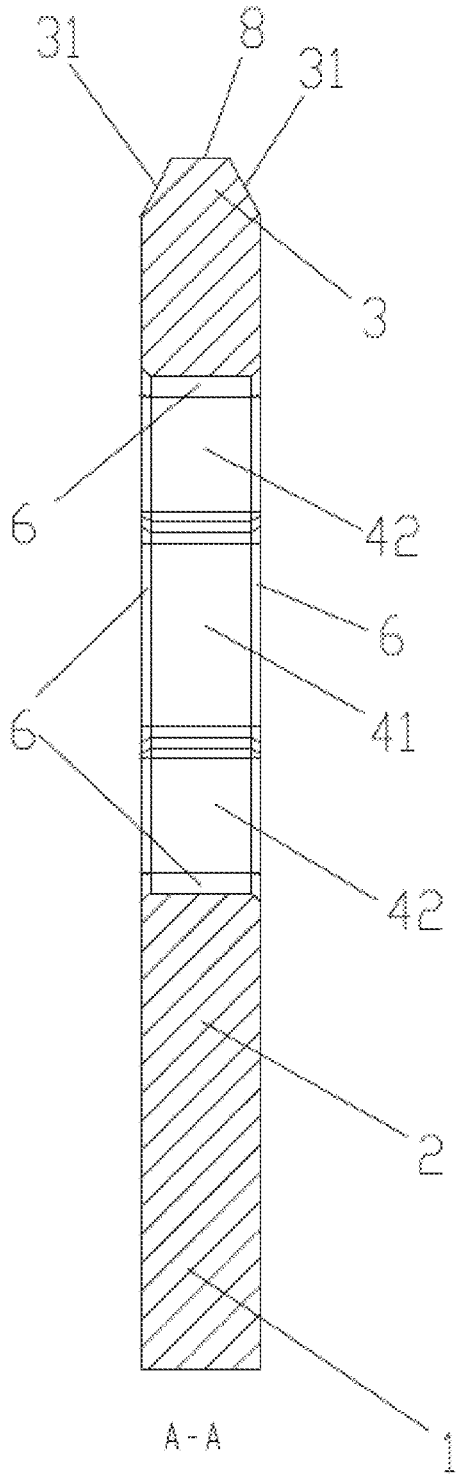
FIG. 3 is a section view of FIG. 2 along Line A-A.

Referring to FIGS. 1-6, the eye-of-needle terminal of the current embodiment, comprises a base portion 1, a pin portion 3, and an elastic portion 2 disposed between the base portion 1 and the pin portion 3, the elastic portion 2 is provided with an eye-of-needle hole 4, the elastic portions 2 comprise a first elastic portion 21 and a second elastic portion 22 which are symmetrically positioned, and the first elastic portion 21 and the second elastic portion 22 are oppositely arranged to form the eye-of-needle hole 4, the extension direction of the eye-of-needle hole 4 is the same as that of the elastic portion 2, the eye-of-needle hole 4 comprises flared holes 42 located at both ends and a connecting hole 41 located between the two flared holes 42, a width of the connecting hole 41 is uniform throughout, while the width of the end of each flared hole 42 facing the connecting hole 41 is greater than the width of the end distant from the connecting hole 41, and in the current embodiment, the width of the connecting hole 41 is greater than the width of the flared holes 42, preferably the width of the connecting hole is 1.5-2.5 times the width of the flared hole, that is the eye-of-needle hole 4 has a shape that is wide at the middle and narrow at both ends, as shown in FIGS. 1-2, in the current embodiment, the width of the connecting hole 41 is 2 times the width of the end of the flared hole 42 facing the connecting hole 41. This configuration can not only increase the contractive elasticity of the eye-of-needle terminal, but also make different positions of the two opposite elastic portions have different cross-sections, and thus the contraction performances of different positions are different, so that it is more convenient to use and laborsaving, on one hand, it can ensure that the eye-of-needle terminal is very easy to insert, and on the other hand it can ensure that the eye-of-needle terminal forms a good connection with the conductive through hole after being inserted and does not easily come out of the conductive through hole, so that the eye-of-needle terminal can be more securely fitted and connected to the conductive through hole of the PCB, and achieve more reliable signal transmission.

As shown in FIGS. 1-2, the two ends of the eye-of-needle hole 4 and the connections between the connecting hole 41 and the flared holes 42 are arced, and the arc configuration enables the stress of the eye-of-needle terminal more balanced when inserting into and removing from the conductive through hole, and the arc configuration makes the eye-of-needle terminal more concise and artistic.

As shown in FIGS. 1-2 and FIGS. 4-5, one side of the eye-of-needle terminal contacting the conductive through hole are arced, that is, the outer side surfaces of the elastic portions are arc side surfaces each comprising an arc flat surface 51 in the middle and two circular arc surfaces 52 located at two sides of the arc flat surface 51. The arc flat surface 51 and the circular arc surfaces 52 cause the eye-of-needle terminal can be more conveniently inserted into the conductive through hole and avoid rigid contact with the conductive through hole, protecting the contact surface.

As shown in FIGS. 1-3 and FIG. 6, in the current embodiment, the eye-of-needle terminal is flat, and four sides thereof are respectively two oppositely arranged platform surfaces 9 and two oppositely arranged arc side surfaces 5. By combining this buffer with the eye-of-needle terminal to insert or remove, when being inserted into a conductive through hole of a PCB, the elastic portions are contracted with respect to each other and inserted into the conductive through hole, after the eye-of-needle terminal is inserted in place, the elastic portions are slowly released to generate an elastic force, and the eye-of-needle terminal is fixed to the conductive through hole by the elastic force, forming a connector for transmitting electric signals. The four corner angles of the arc side surfaces 5 are arced, and is rounded to achieve a smooth surface, protecting the contact surface. Moreover, the front ⅓ of the eye-of-needle terminal is the insertion guide portion, and the middle ⅓ of the eye-of-needle terminal is the portion that elastically contacts the conductive through hole of the PCB.

Figure 4:
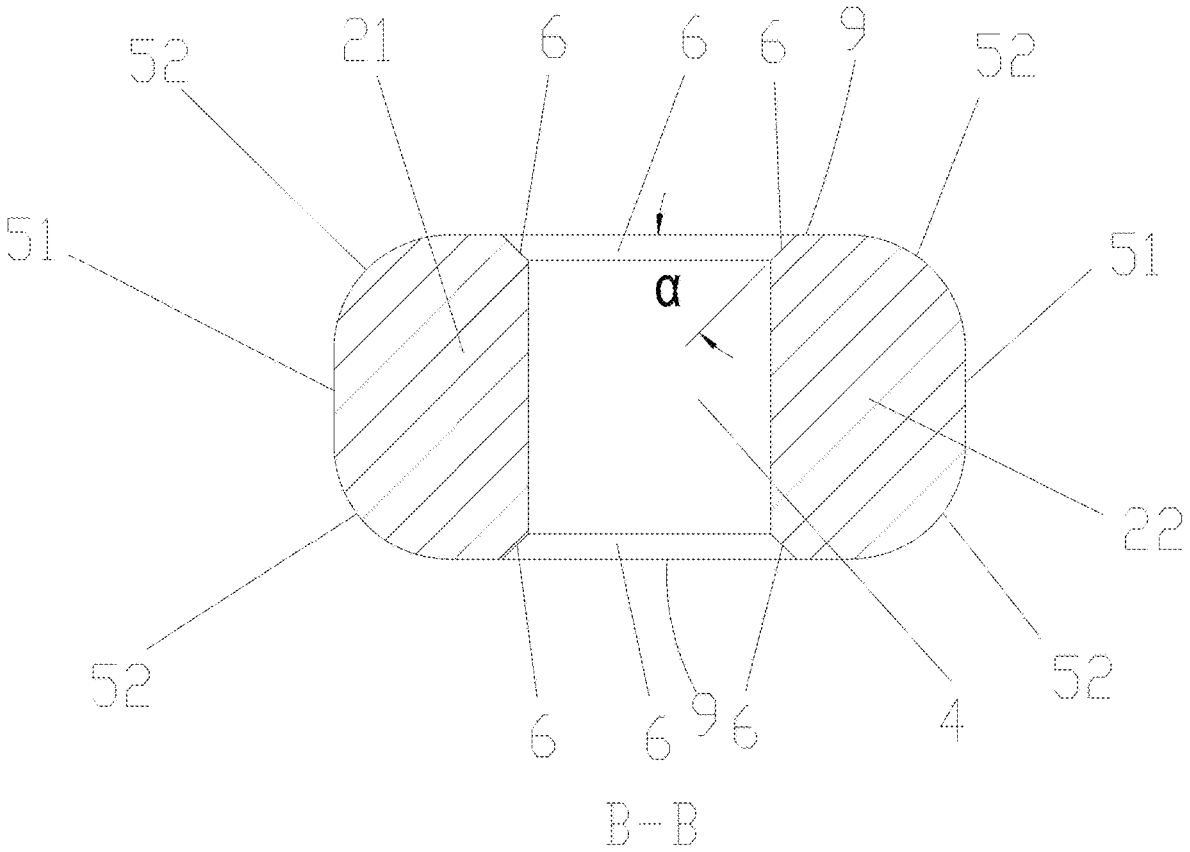
FIG. 4 is a section view of FIG. 2 along Line B-B.

As shown in FIGS. 1-4, in the current embodiment, the edge of the eye-of-needle hole 4 is further provided with an inclined chamfer 6. As shown in FIG. 4, the inclined surface of the inclined chamfer 6 faces the outside, and an angle a between the inclined surface and the platform surface 9 of the eye-of-needle terminal is 30-60°, in the current embodiment preferably 45°, and in FIG. 4, some lines are omitted in order to show the inclined chamfer 6 more clearly. The advantage of providing the inclined chamfer 6 is that if the eye-of-needle terminal needs to be permanently fixed, soldering can be used, the melted tin-containing solder can pass through the inclined chamfer 6 as an introduction hole, so that more tin-containing solder can enter the eye-of-needle hole 4, and the connection between the eye-of-needle terminal and the conductive through hole is more tight, preventing problems such as poor contact caused by virtual welding.

As shown in FIGS. 1-3 and FIGS. 5-6, inclined surfaces 31 are provided around the end of the pin portion 3, a bottom edge of each inclined surface 31 comprises a straight edge 71 in the middle and arc edges 72 located at two sides of the straight edge 71, a horizontal projection of the arc edges 72 of four inclined surfaces 31 can combine into a circle, a top surface 8 of the end of the pin portion 3 is square, and the configuration of the square top surface 8 causes the end of the eye-of-needle terminal is more uniformly stressed. The arc configurations of the inclined surfaces 31 and the bottom edges of the inclined surfaces 31 cause the end portion of the eye-of-needle terminal can be more conveniently inserted into the conductive through hole and avoid damage to the conductive through hole by the sharp edges and corners.

Figure 5:
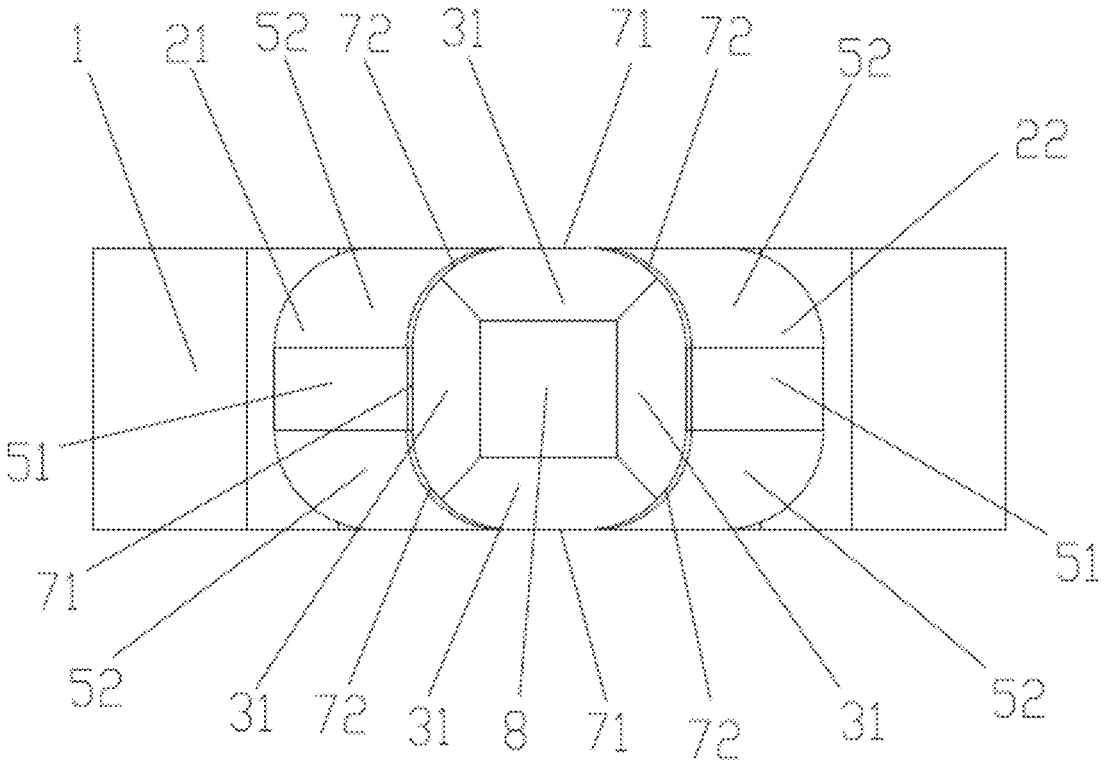
FIG. 5 is a top view of the eye-of-needle terminal in the preferred embodiment of the present disclosure.
Figure 6:
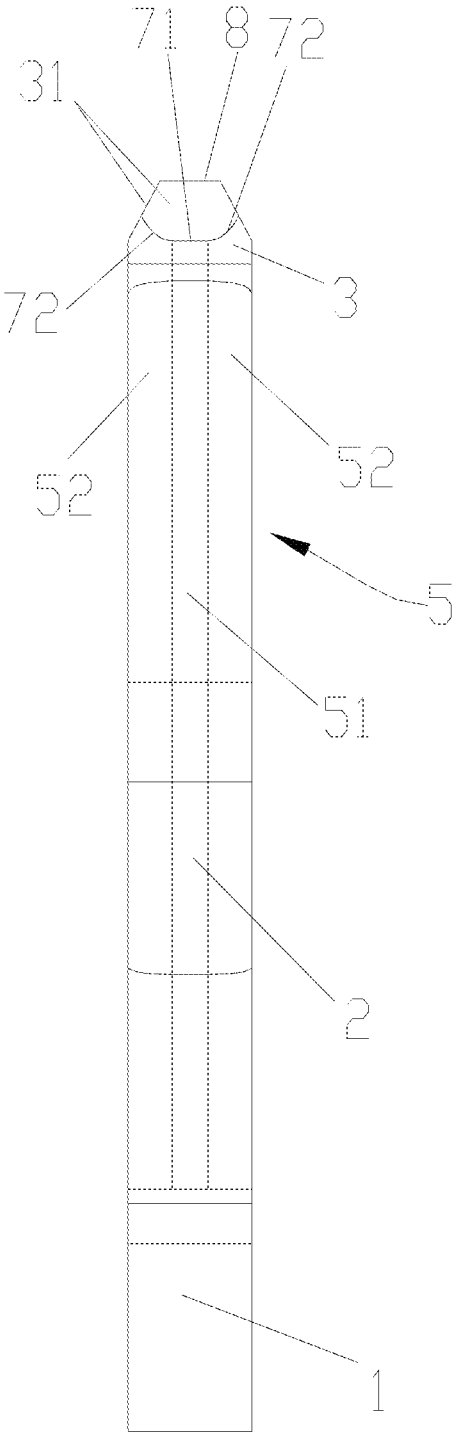
FIG. 6 is a side view of the eye-of-needle terminal in the preferred embodiment of the present disclosure.

Referring to FIG. 5, a horizontal projection of the arc edges 72 of four inclined surfaces 31 can combine into a first circle, any four circular arc surfaces 52 at the same position on the other two oppositely arranged arc side surface can be combined to form a second circle on the horizontal projection, and in the current embodiment, the first circle and the second circle have the same size. By means of this configuration, not only causes the eye-of-needle terminal can be more conveniently inserted, will not generate a strong rigid contact with the through hole of the circuit board, ensuring the subsequent electric connection, but also causes elasticity between the first elastic portion 21 and the second elastic portion 22 is moderate, which has a certain resistance to the squeezing of the through hole of the circuit board, so that the eye-of-needle terminal has a longer service life and a reduced damage rate.

The eye-of-needle terminal of the present disclosure, has a reasonable structure design, by designing the eye-of-needle hole to be wide at the middle and narrow at both ends, so that the cross section of the elastic portions is not equal everywhere, the elastic force between the first elastic portion and the second elastic portion will vary with the stress position and is maintained within the appropriate range, thereby not only ensuring that the eye-of-needle terminal is very easy to insert, but also ensuring that the eye-of-needle terminal forms a good connection with the conductive through hole after being inserted and does not easily come out of the conductive through hole, therefore, the eye-of-needle terminal can be more securely fitted and connected to the conductive through hole of the PCB, achieve more reliable signal transmission, can well solve the problem of poor contact, and can avoid rubbing the conductive through hole of the PCB during insertion and removal, has longer service life; the arc-shaped configurations at multiple positions not only make the eye-of-needle terminal more evenly stressed during insertion and removal, but also make the overall appearance more beautiful and simple.

The embodiments described above are only for illustrating the technical concepts and features of the present disclosure, and are intended to make those skilled in the art being able to understand the present disclosure and thereby implement it, and should not be concluded to limit the protective scope of this disclosure. Any equivalent variations or modifications according to the spirit of the present disclosure should be covered by the protective scope of the present disclosure.

The invention claimed is:

1. An eye-of-needle terminal, comprising:

a base portion, a pin portion, and an elastic portion disposed between the base portion and the pin portion, the elastic portion being provided with an eye-of-needle hole, wherein the eye-of-needle hole comprises flared holes located at both ends and a connecting hole located between the two flared holes, and a width of the end of each flared hole facing the connecting hole is greater than a width of the end distant from the connecting hole, wherein inclined surfaces are provided around the end of the pin portion, and wherein a bottom edge of each inclined surface comprises a straight edge in the middle and arc edges located at two sides of the straight edge, and a horizontal projection of the arc edges of four inclined surfaces can combine into a first circle.

2. The eye-of-needle terminal according to claim 1, wherein a width of the connecting hole is greater than a width of the flared holes.

3. The eye-of-needle terminal according to claim 1, wherein the two ends of the eye-of-needle hole is arced, and connections between the connecting hole and the flared holes are arced.

4. The eye-of-needle terminal according to claim 1, wherein the elastic portions comprise a first elastic portion and a second elastic portion, and the first elastic portion and the second elastic portion are oppositely arranged to form the eye-of-needle hole.

5. The eye-of-needle terminal according to claim 1, wherein an edge of the eye-of-needle hole is provided with an inclined chamfer.

6. The eye-of-needle terminal according to claim 5, wherein the eye-of-needle terminal is flat, and four sides of the eye-of-needle terminal are respectively two oppositely arranged platform surfaces and two oppositely arranged arc side surfaces.

7. The eye-of-needle terminal according to claim 6, wherein an inclined surface of the inclined chamfer faces the outside, and an angle $\alpha$ between the inclined surface of the inclined chamfer and the platform surface is 30-60°.

8. The eye-of-needle terminal according to claim 6, wherein edges and corners of the arc side surfaces are arced.

9. The eye-of-needle terminal according to claim 6, wherein an outer side surface of each elastic portion comprises an arc flat surface in the middle and two circular arc surfaces located at two sides of the arc flat surface.

10. The eye-of-needle terminal according to claim 9, wherein any four circular arc surfaces at the same position on the two oppositely arranged arc side surface can be combined to form a second circle on the horizontal projection.

11. The eye-of-needle terminal according to claim 10, wherein the first circle and the second circle have the same size.

12. The eye-of-needle terminal according to claim 1, wherein a top surface of the end of the pin portion is square.

* * * * *